United States Patent [19]

Leistner

[11] Patent Number: 4,472,956

[45] Date of Patent: Sep. 25, 1984

[54] APPARATUS FOR FEEDING ELONGATED OBJECTS

[75] Inventor: Walter H. Leistner, Willowdale, Canada

[73] Assignee: Sigma Tool & Machine Limited, Scarborough, Canada

[21] Appl. No.: 392,467

[22] Filed: Jun. 28, 1982

[51] Int. Cl.[3] ..... B21H 3/04; B21G 3/32; B21K 27/00

[52] U.S. Cl. ..... 72/92; 10/169; 72/103

[58] Field of Search ..... 10/4, 9, 20.5, 21, 31, 10/39, 52, 59, 60, 69, 169; 72/92, 93, 105, 106, 424, 103; 221/169, 265

[56] References Cited

U.S. PATENT DOCUMENTS

| | | | |
|---|---|---|---|
| 2,273,782 | 2/1942 | Irwin | 10/169 |
| 2,657,402 | 11/1953 | Poupitch | 10/20.5 X |
| 4,309,820 | 1/1982 | Schindel | 10/155 A X |

FOREIGN PATENT DOCUMENTS

| | | | |
|---|---|---|---|
| 183668 | 5/1963 | Sweden | 72/92 |
| 550208 | 3/1977 | U.S.S.R. | 72/92 |
| 647046 | 2/1979 | U.S.S.R. | 72/92 |

*Primary Examiner*—E. Michael Combs
*Attorney, Agent, or Firm*—George A. Rolston

[57] ABSTRACT

Feeding apparatus for elongated objects having a rotary feed member, having a drive for rotating the same at a high speed, spaced apart parallel grooves formed in the outer circumference of the rotary member spaced apart radially from one another, to receive a single elongated object, angled shoulders formed on the outer periphery of the rotary member, located adjacent respective grooves, a recess formed in the rotary member intermediate its upper and lower ends, an ejection device located in the recess for engaging and ejecting objects at a predetermined rotational position and a generally semi-annular retaining guide, around a portion of the rotary member, for retaining objects in the grooves.

12 Claims, 7 Drawing Figures

APPARATUS FOR FEEDING ELONGATED OBJECTS

The invention relates to a rotary feed mechanism for feeding elongated metal workpieces to a processing line, and is of particular utility in association with the feeding of nails, screws, finished or unfinished fastening components such as bolts, pins, and the like.

The processing of elongated metal workpieces, such as blanks for nails, screws and the like fasteners, usually involve the feeding or supplying of such workpieces to a processing line at regular spaced apart intervals, and in a precise orientation. Examples of such processing lines are thread rolling machines, which may be rolling threads on nails, screws, or other fasteners, and collating machines or other packaging machines, which may be collating the fasteners into an assembly such as a strip or the like. It will of course be appreciated that these are simply two examples of a variety of different processing lines to which such workpieces may have to be fed, and the invention is not to be taken as limited to any such specific processing line.

In many cases, the elongated workpieces will have been pre-manufactured into blanks at another station, or on another machine, and are then transported usually in a random fashion to the processing line. In many cases, such transport involves simply carrying a container full of such blanks, dumping them in a supply hopper, and feeding the workpieces from the supply hopper down a chute. Typically, such a chute consists essentially of two spaced apart parallel bars forming a channel, down which the workpieces slide under the influence of gravity. In many cases, the workpieces have heads, which may be formed somewhat irregularly and which in any event tend to cause the workpieces to bunch up at the end of chute, and cause frequent jamming of the feeding of such workpieces.

In addition, it is difficult to pick up a single such workpiece from such a chute, and feed it into a further processing machine, at regular spaced apart intervals and in a precise orientation, at any degree of speed.

As a result, although such processing machinery may well be able to operate itself at a relatively high speed, the speed of operation is limited by the speed at which the workpieces can be fed into such processing line.

A typical example of such processing is shown for example in U.S. Pat. No. 3,741,767. In this patent, there is disclosed a loading device for feeding screw blanks into some other form of processing machinery. A further example is shown in U.S. Pat. No. 3,277,684. Again, such patent shows the feeding of such screw blanks into a thread rolling die.

Devices such as these and others which are shown in the art have not operated with a sufficient degree of reliability, and at a sufficient speed, to satisfy current and future demands. Where one of the workpieces in the chute was bent or damaged the feeding device would usually jam, causing costly down time. As the technology relating to the processing machines such as collators, thread rolling machines and the like, improves, the principle limiting factor on the operation of such machines is in fact the rate at which such blanks can be fed into them.

It is therefore a general objective of the invention to provide a rotary feed device for feeding elongated workpieces into a processing line which can receive individual workpieces, space them, align them precisely, and feed them directly into such processing machine at a much higher rate of speed than that heretofor possible, and with a greater degree of reliability.

With a view to providing these advantages, the invention comprises a rotary feed member, of generally circular shape in plan, and having a central axis about which it may be rotatably mounted, and having drive means for rotating the same, such rotary member having a plurality of spaced apart parallel generally vertical grooves formed in its outer circumference, said grooves being spaced apart circumferentially from one another, each of said grooves being shaped and adapted to receive a single said workpiece, and being of greater width and depth than the maximum width of the shank of the workpiece, said member being adapted to rotate in a predetermined direction, and said member being formed with upper and lower surfaces, and including angled shoulder means formed on the outer periphery of said rotary member, commencing at said upper surface, and extending part way down such periphery, and located adjacent respective ones of said grooves, and being located on the side of said grooves in the direction of such predetermined rotation, said shoulder means defining an acute angle with respect to a horizontal plane, and recess means formed in said periphery of said rotary member intermediate its upper and lower surfaces, and an ejection member located in said recess means for engaging individual workpieces in said grooves and ejecting therefrom at a predetermined rotational position of said member, and, generally semi-annular retaining means, around a portion of said rotary member, for aligning and retaining said workpieces in said grooves until they reach said ejection member said retaining means defining a leading end and a trailing end, said leading end defining upper and under surfaces, the under surface being angled upwardly towards said leading end to define a generally tapering formation, whereby to engage said elongated objects initially at their upper ends, as the same rotate with said rotary feed member, into engagement with said retaining means.

More specifically, it is an objective of the invention to provide such a rotary feed device which may be driven independently of the drive for the further processing line. In this way, by varying the speed of the feed device, the spacing of the workpieces on the processing line can be adjusted.

More specifically, it is an objective to provide such a feed device incorporating cutting means for severing imperfect workpieces.

More specifically, it is an objective of the invention to provide such a rotary feed device which is readily removable from and replaceable by an alternate such feed device with different size grooves, for accommodating different sizes of workpieces.

It is a further and related objective of the invention to provide such a rotary feed device in which, in the lower portion of such feed device, there are a plurality of relatively wide recesses formed between said parallel workpiece grooves.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

Figure 1:
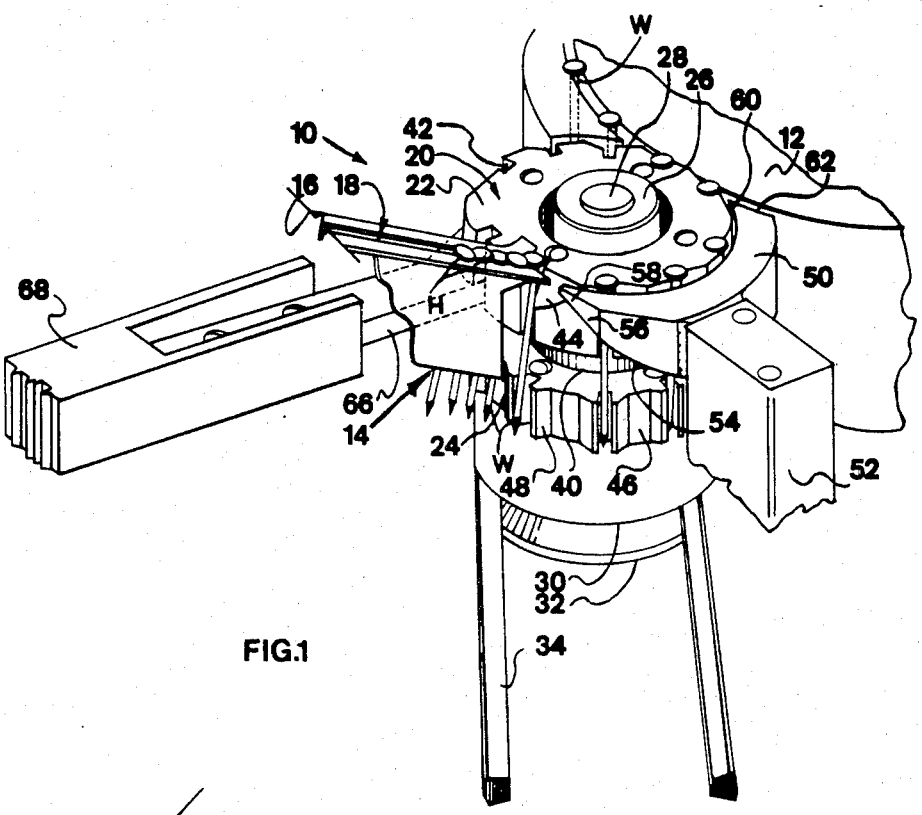
FIG. 1 is a perspective illustration, partially cut away, showing the rotary feed device, used in association with a rotary thread rolling die.

Referring first of all to FIG. 1, it will be noted that for the purposes of this description, a rotary feed device indicated generally as 10 is shown associated with a rotary thread rolling die indicated generally as 12, and is used for feeding individual blanks or workpieces W.

Such a thread rolling die is of course well known in the art, and description thereof is omitted for the sake of clarity. It will of course be appreciated that details of the thread rolling die are in any event irrelevant for the purposes of this invention, and the invention is equally applicable to other processing lines or devices for processing such workpieces W. Such processing lines may of course include collators for collating nails or screws or other fasteners, or other packaging or forming machinery such as is well known in the art, where such further processing machinery requires such workpieces W to be fed to it in predetermined locations, and at precise spacings or intervals.

In addition, for the purposes of this invention, it is understood that the workpieces W are being fed to the rotary feeding device, along a chute indicated generally as 14. Such a chute 14 may be supplied from any suitable source such as a hopper (not shown) or any other means well known in the art. For example, the chute may in fact be a continuous carriage, receiving workpieces from a previous processing station, and moving them continuously along such a chute, without the interposition of a hopper.

As noted above, the invention is not to be taken as limited to any specific form of such a supply means, the chute 14 being shown merely by way of example.

As shown in FIG. 1, the chute 14 is comprised of two parallel spaced apart bars 16—16, defining a groove 18. The workpieces W have heads H, which rest on the upper edges of the bars 16—16 and prevents the workpieces from falling through the slot 18. As the workpieces reach the end of the chute, they tend to bunch up at the end of the chute in a random somewhat irregular fashion, and frequent jams are experienced at this point, in typical feeding devices. It will of course be understood that it is intended that individual workpieces W shall be delivered from the end of the chute, one at a time, while retaining the remainder of such workpieces in the chute, and they must then be precisely oriented and located in predetermined spacing, for feeding to the thread rolling die 12.

With additional reference to FIGS. 2, 3, 4 and 5, the rotary feeding device 10 will be seen to comprise a generally cylindrical metallic wheel-like device 20, having upper and lower surfaces 22 and 24, and rotary bearing means 26 located on its central axis, receiving a spindle or shaft 28.

Shaft 28 extends downwardly in and passes through a drive device 30, in this case having a pulley groove 32 for driving by belt 34. It will of course be appreciated, however, that other such drive means may be used, and this is shown merely by way of example. Rotary feed member 20 is fastened to drive device 30 by means such as bolts 36, entering through counter-bores 38. Body 20 is divided partially, into upper and lower portions, by means of an intermediate annular recess 40, for reasons to be described.

Further bearings (not shown) will be provided as needed on spindle or shaft 28 for supporting feed member 20, and drive member 30, the details of which are omitted for the sake of clarity.

Around its outer periphery, the body 20 is formed with a plurality of elongated narrow grooves 42, extending in an axial manner, along parallel spaced apart axes, all of which are circumferentially spaced apart about the central axis defined by spindle 28.

As shown, in this example of the invention, such grooves extend completely from top to bottom of the body 20. It will of course be appreciated, however, that such grooves 42 need only be as long as the longest of the fastener blanks or workpieces W, with which it is intended to be used, and they could conceivably have blind ends if desired at their lower ends.

Individual fastener blanks or workpieces are received in such grooves one at a time, from the chute 14, and are then swung around an arc of about 180° until they meet with the processing machine such as the thread rolling die 12. At this point they are ejected from their respective slots 40, and fed into the processing machine.

In order to facilitate the entry of the workpieces W into the grooves 42, at a high rate of speed, from chute 14, the body 20 is provided with generally flattened planar angled shoulders 44 adjacent one side of respective grooves 42, adjacent the upper surface 22 and extending part-way down, between such upper surface 22 and the annular recess 40.

In addition, in order to facilitate clearance of the workpieces W from the chute 14, the lower portion of the body 20, between the recess 40 and the lower surface or underside 24, is relieved or cut away as at 46 between individual grooves 42. This defines angled camming surfaces 48 on either side of the grooves 42 for reasons to be described below.

It is found that the combination of the angled shoulders 44, recesses 46 and camming surfaces 48 cooperate together to greatly increase the speed and reliability with which the workpieces W may be picked up from the channel 14, without jamming.

In order to retain the workpieces W in their individual grooves 42 as they are rotated around by body 20, a generally semi-annular retaining cuff 50 is provided, mounted on any suitable means such as the post 52. Cuff 50 is of a substantial height, extending over a major distance from the upper surface 22 of body 20 downwardly, and is preferably located in about the same plane as upper surface 22, so as to cooperate with upper surface 22 in engaging and retaining the heads H of the workpieces W at the desired height.

Cuff 50 has an upwardly angled under edge 54 at its upstream end, and is preferably provided with a flattened shoulder 56 providing a sharp leading end 58.

At its downstream end 60, cuff 50 is provided with a flattened profile 62, so that it may closely abut against thread rolling die 12.

Figure 6:
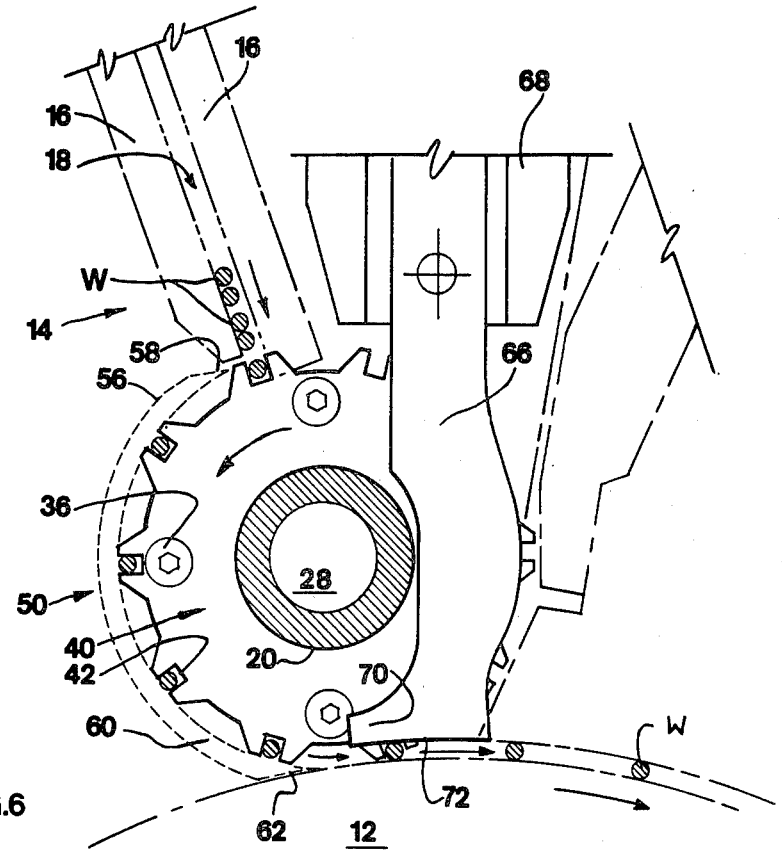
FIG. 6 is a section along 6—6 of FIG. 4.

Note that in FIG. 6 the location of the cuff 50 is shown in phantom. In fact, the cuff 50 would not extend as low as the section line 6—6 of FIG. 4, but it is shown simply for the sake of clarity.

If a nail or workpiece W is badly misaligned or bent when it leaves channel 14, then the cuff 50 and its angled edge 54 function to sever the shank of the workpiece. This avoids troublesome jamming of the rotary feeder by a misaligned or bent workpiece. This was a problem with earlier feeders, when they were used for longer, lighter workpieces, such as nails.

The cut off portion of the workpiece drops away. The truncated portion remains in its groove. Detector means (not shown) will detect such an imperfect blank, and stop the feeder. It can then be removed, and replaced with a complete blank, without jamming the machine.

In order to ensure positive ejection of workpieces W from their grooves 42, when they reach thread rolling die 12 (or the next piece of equipment in the processing line), an ejector arm 66 is provided, mounted on a bracket 68. Ejector arm 66 has a semi-arcuate extractor finger 70, extending into recess 40 in body 20. Finger 70 is curved or at least profiled to extend part-way around recess 40, into a position more or less concentric with the thread rolling die 12. Finger 70 has a generally curved retaining edge 72, spaced radially from the surface of thread rolling die 12, which cooperates with thread rolling die 12 to ensure that the workpieces W are fed to the die 12 in the desired relationship.

Clearly, the arm 66 may be adjustable or replaceable depending upon the diameter of the workpieces W, or shape of die 12.

In operation, workpieces W are fed to the body 20 along any feed means such as the chute 14 or other conveyor means.

The body 20 is driven in an anti-clockwise direction in this embodiment, by means of belt 34. Clearly, belt 34 is itself driven by any suitable belt drive system (not shown), the detail of which will be well understood to persons in the art. Such drive system will have a variable speed control so that it may drive the body 20 at a variety of rotational speeds.

Figure 2:
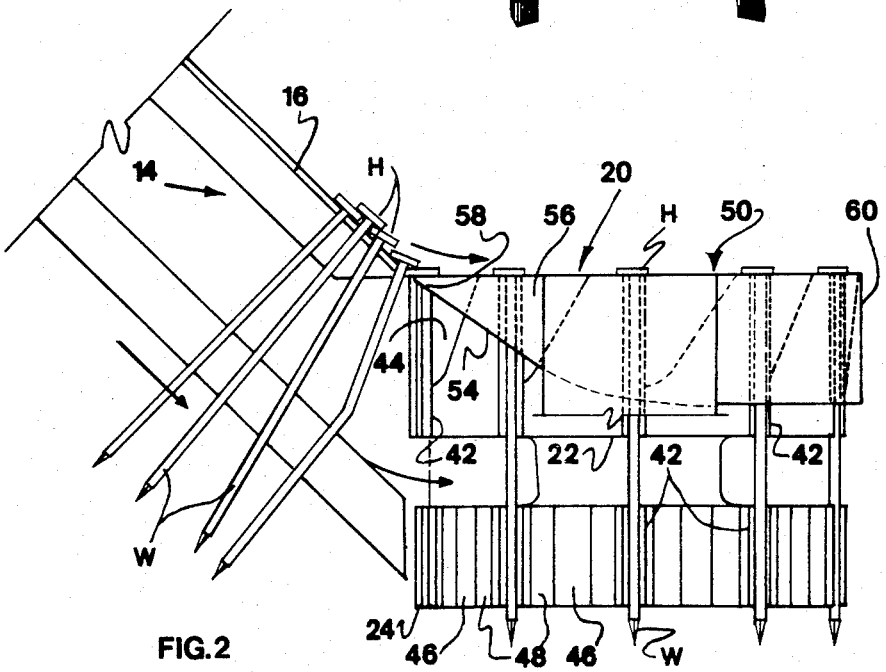
FIG. 2 is an elevation of the feed device of FIG. 1.
Figure 3:
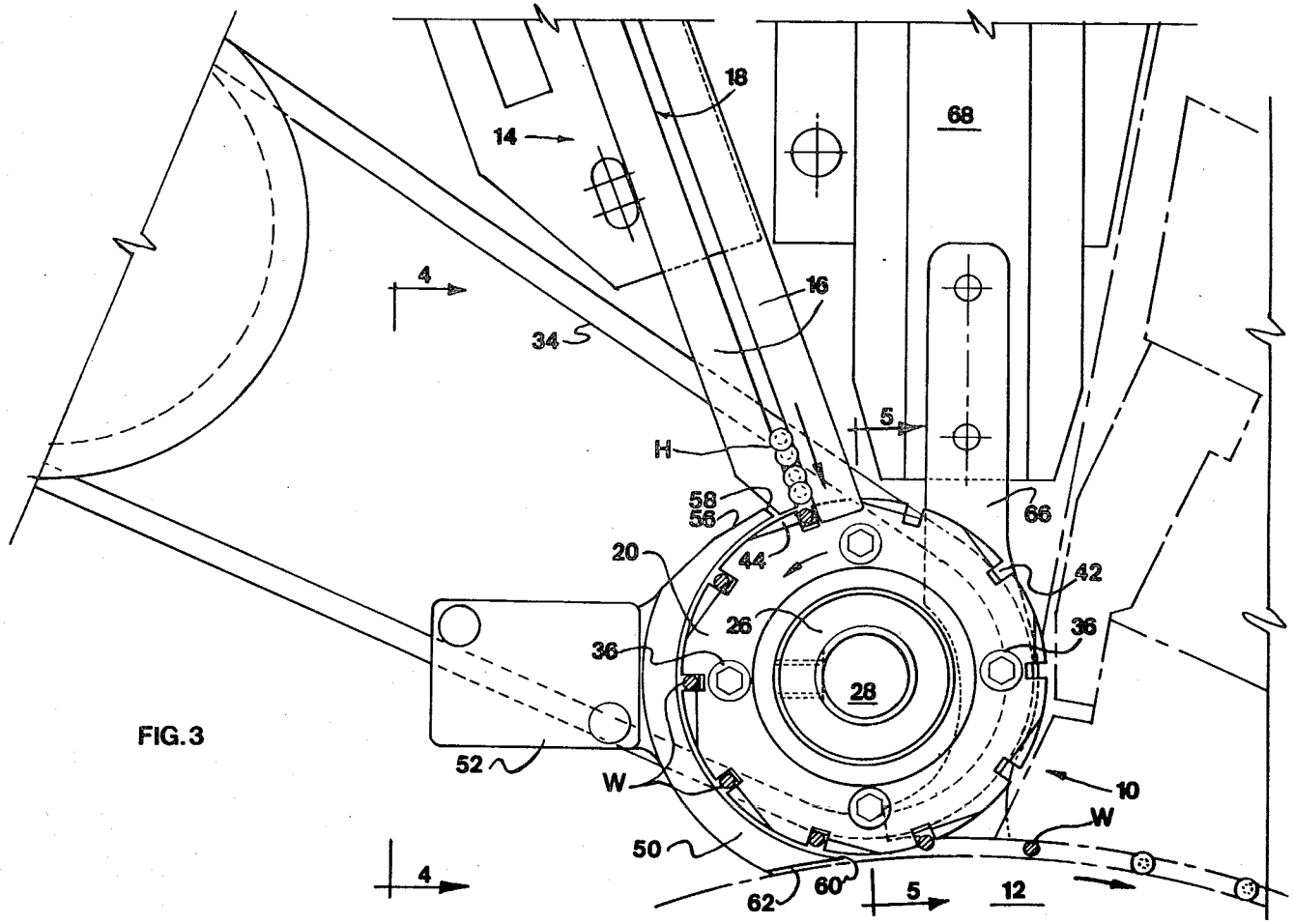
FIG. 3 is a top plan view of the rotary feed device of FIG. 1.
Figure 4:
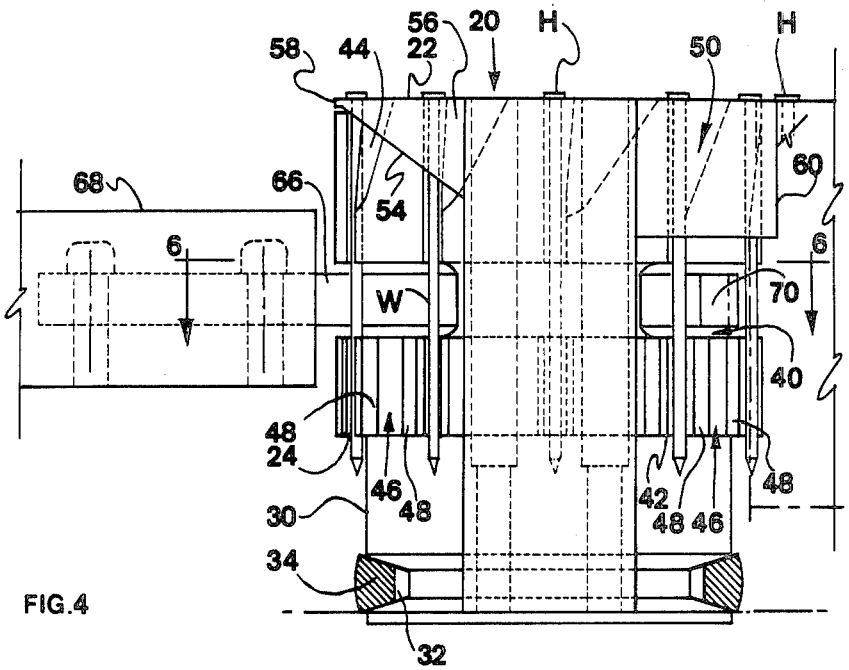
FIG. 4 is an elevation view from the line 4—4 of FIG. 3.
Figure 5:
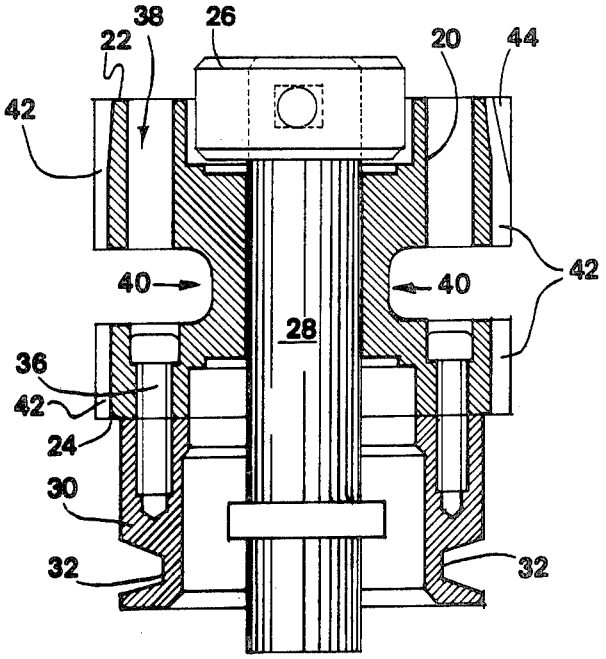
FIG. 5 is a section along 5—5 of FIG. 3.

As one of the flattened shoulders 44 rotates into registration with the chute 14, the upper portion of a workpiece W will swing out of the chute 14, and will then drop into the upper end of groove 42, which by that time has swung into registration with chute 14 (FIGS. 1 and 2).

Due to the shaping and location of the flattened shoulders 44, the workpieces W will thus feed positively one at a time from the chute 14.

As the body 20 continues to rotate, the workpiece W which has just entered the groove 42, will then be swung out of registration with chute 14, and into engagement with the end 54 of cuff 50. As explained above, the end 54 of cuff 50 is cut away as at 56.

The effect of this cut away portion is to permit the workpiece W to enter only the upper portion of its groove 42 so that during the initial few degrees of rotation of body 20, the workpiece W will in fact be swung outwardly by centrifugal force (FIG. 1).

However, as the workpiece W engages the cuff 50, the cuff 50 will force the workpiece W to swing downwardly into its groove 42, so that it is aligned essentially parallel to the axis of shaft 28. Body 20 continues to rotate carrying each workpiece W around within the confines of cuff 50, until it reaches the next piece of equipment in the processing line, in this case the thread rolling die 12. At this point, the workpiece W is released from cuff 50, and contacts the thread rolling die 12. As soon as it does so, the workpiece W will then also be engaged by the finger 70 of arm 66, and will be forced out of its groove 42, and will be jammed securely between the curved surface 72 of arm 66 and the die 12.

It will of course be appreciated that the shaping of the surface 72 is dependent upon the nature of the next piece of processing equipment in the line to which the workpieces are being fed. Where such equipment is the thread rolling die 12, then the surface 72 is arcuate.

However, where the piece of equipment is for example a collating machine, then the surface 72 may have a different configuration.

The workpieces W are then processed by such further equipment, in precisely regulated spaced apart intervals.

It will of course be appreciated that the body 20 can be rotated much faster than the peripheral speed of the die 12, or other collating equipment. This will then have the effect of delivering the workpieces W to such processing equipment either closer together or further apart. In this way it is possible to provide the optimum spacing for the speed of operation of such equipment.

Figure 7:
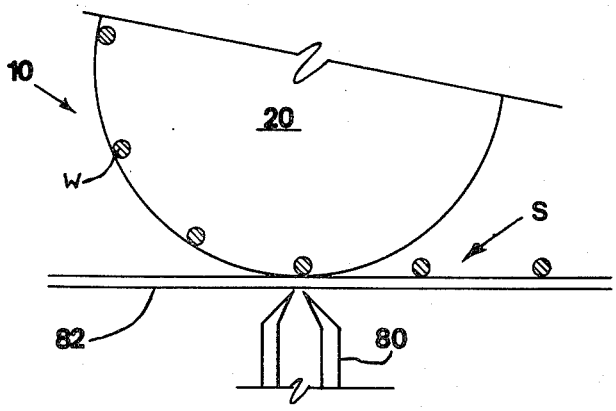
FIG. 7 is a schematic of an alternate embodiment.

One alternative form of such equipment is shown schematically in FIG. 7. In this case, the rotary feed device 10 is indicated simply by the body 20, and workpieces W are shown feeding to a spot welding station 80, welding the workpieces W to strands of wire 82. In this way a continuous collated fastener strip S is formed in which the workpieces W are welded to spaced apart wires 82, in parallel spaced apart relation. In this way, they are rendered suitable for use in power operated fastener driving devices.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. Apparatus for feeding elongated rigid objects, each of said objects defining a head and a shank, said apparatus comprising;

a rotary feed member, and having a central axis about which it may be rotatably mounted, and having drive means for rotating the same and having upper and lower ends;

a plurality of spaced apart parallel generally vertical grooves formed in the outer circumference of said rotary member, said grooves being spaced apart circumferentially from one another, each of said grooves being shaped and adapted to receive a single said elongated object and being of greater width and depth than the maximum width of the shank of said object;

angled shoulder means formed on the outer periphery of said rotary member, commencing at said upper end, and extending part-way down such periphery, and located adjacent respective ones of said grooves, and on the side of said grooves in the direction of such predetermined rotation, said shoulder means defining an acute angle with respect to a horizontal plane;

annular recess means formed in said periphery of said rotary member intermediate its upper and lower ends;

an ejection member located in said recess means for engaging objects in said grooves and ejecting them therefrom at a predetermined rotational position of said member, and, generally semi-annular retaining means, around a portion of said rotary member, for aligning and retaining said objects in said grooves until they reach said ejection member, said retaining means defining a leading end and a trailing end, said leading end defining upper and under surfaces, the under surface being angled upwardly towards said leading end to define a generally tapering formation, whereby to engage said elongated objects at their upper ends, as the same rotate with said rotary feed member into engagement with said retaining means and cause each said object to seat loosely in a respective groove with its head supporting it on the top of said rotary member.

2. Apparatus for feeding elongated objects as claimed in claim 1 including delivery chute means arranged in association with said rotary feed member, for delivering said elongated objects one after the other thereto, and wherein said semi-annular retaining means extends around said rotary feed member from a point adjacent said chute, to a point adjacent said ejection member.

3. Apparatus for feeding elongated objects as claimed in claim 1 including drive means operatively connected to said rotary feed member, for rotating the same at varying speeds, whereby the rate of delivery of said objects may be varied.

4. Apparatus for feeding elongated objects as claimed in claim 1 including depressions formed in the outer circumference of said rotary member between said spaced apart parallel grooves.

5. Apparatus for feeding elongated objects as claimed in claim 1 including drive means for driving said rotary feed member, and releasable fastening means for fastening said rotary feed member to said drive means, whereby said rotary feed member may be removable therefrom.

6. Apparatus for feeding elongated objects as claimed in claim 1 wherein said semi-annular retaining means comprises a curved bar having inner and outer surfaces, the inner surface having a radius of curvature slightly greater than the radius of said rotary feed member, whereby to define a continuous regular curve therearound, for engaging said objects and retaining them in position in their grooves, and wherein said trailing end is located adjacent said ejection member.

7. Apparatus for feeding elongated rigid objects, each of said objects defining a head and a shank, said apparatus comprising:

a rotary feed member, and having a central axis about which it may be rotatably mounted, and having drive means for rotating the same and having upper and lower ends;

a plurality of spaced apart parallel generally vertical grooves formed in the outer circumference of said rotary member, said grooves being spaced apart circumferentially from one another, each of said grooves being shaped and adapted to receive a single said elongated object and being of greater width and depth than the maximum width of the shank of said object;

angled shoulder means formed on the outer periphery of said rotary member, commencing at said upper end, and extending part-way down such periphery, and located adjacent respective ones of said grooves, and on the side of said grooves in the direction of such predetermined rotation, said shoulder means defining an acute angle with respect to a horizontal plane;

annular recess means formed in said periphery of said rotary member intermediate its upper and lower ends;

an ejection member located in said recess means for engaging objects in said grooves and ejecting them therefrom at a predetermined rotational position of said member, and, generally semi-annular retaining means, around a portion of said rotary member, for aligning and retaining said objects in said grooves until they reach said ejection member, said retaining means defining a leading end and a trailing end, said leading end defining upper and under surfaces, the under surface being angled upwardly towards said leading end to define a generally tapering formation, whereby to engage said elongated objects at their upper ends, as the same rotate with said rotary feed member into engagement with said retaining means and cause each said object to seat loosely in a respective groove with its head supporting it on the top of said rotary member, wherein said semi-annular retaining means comprises a curved bar having inner and outer surfaces, the inner surface having a radius of curvature slightly greater than the radius of said rotary feed member, whereby to define a continuous regular curve therearound, for engaging said objects and retaining them in position in their grooves, and wherein said curved bar includes cutting edge means formed on said leading end of said curved bar, said cutting edge means being located and adapted to engage and cut off portions of said elongated objects which do not fit within respective said grooves.

8. Apparatus for processing elongated rigid objects, each of said objects defining a head and a shank, said apparatus comprising;

a processing machine for sequentially processing said elongated objects, said processing maching having an entry point at which said elongated objects are introduced to said machine;

a rotary feed member associated with said processing machine, and having upstream and downstream locations, the downstream location of said rotary feed member being located adjacent the entry point of said processing machine;

a plurality of spaced apart parallel generally vertical grooves formed in said rotary feed member, said grooves being spaced apart circumferentially and each being shaped and adapted to receive a single said elongated object and being of greater width and depth than the maximum width of the shank of said object;

angled shoulder means formed on the outer periphery of said rotary member, commencing at said upper end, and extending part-way down such periphery, and located adjacent respective ones of said grooves, and on the side of said grooves in the direction of such predetermined rotation, said shoulder means defining an acute angle with respect to a horizontal plane;

an ejection member located adjacent said downstream end of said rotary feed member, for ejecting elongated objects therefrom and introducing them to said entry point of said processing machine;

generally semi-annular retaining means, around a portion of said rotary member, for aligning and retaining said objects in said grooves until they reach said ejection member said retaining means defining a leading end and a trailing end, said leading end defining upper and under surfaces, the under surface being angled upwardly towards said leading end to define a generally tapering formation, whereby to engage said elongated objects initially at their upper ends, as the same rotate with said rotary feed member, into engagement with said retaining means and cause each said object to seat loosely in a respective groove with its head supporting it on the top of said rotary member;

delivery means for delivering elongated objects to said entry point of said rotary feed member, and, drive means for driving said rotary feed member at varying rotational speeds, whereby the speed of said rotary feed member may be varied independently of the operation of said processing machine.

9. Apparatus for processing elongated objects as claimed is claim 8 wherein said processing machine comprises a rotary thread rolling die, for rolling thread formations in said elongated objects.

10. Apparatus for processing elongated objects as claimed in claim 8 wherein said processing machine comprises a strip forming apparatus, for receiving said elongated objects, and for fastening the same into a strip of such objects.

11. Apparatus for processing elongated objects as claimed in claim 10 wherein said strip forming machine comprises welding means for welding respective said elongated objects to metallic wires, for fastening the same together into a strip of such objects.

12. Apparatus for processing elongated objects as claimed in claim 8 wherein said semi-annular retaining means comprises a curved bar having inner and outer surfaces, the inner surface having a radius of curvature slightly greater than the radius of said rotary feed member, whereby to define a continuous regular curve therearound, for engaging said ojects and retaining them in position in their grooves, and wherein said trailing end is located adjacent said ejection member, wherein said curved bar includes cutting edge means formed on said leading end of said curved bar, said cutting edge means being located and adapted to engage and cut off portions of said elongated object which do not fit within respective said grooves.

* * * * *